US006804939B2

(12) United States Patent
Samborn et al.

(10) Patent No.: US 6,804,939 B2
(45) Date of Patent: Oct. 19, 2004

(54) SHEET SETS PACKAGING SYSTEM

(75) Inventors: Michael R. Samborn, Atlanta, GA (US); Parks C. Stewart, Norcross, GA (US); John Shoupp, Sugar Hill, GA (US)

(73) Assignee: Phoenix Automation, Inc., Norcross, GA (US)

( * ) Notice: Subject to any disclaimer, the term of this patent is extended or adjusted under 35 U.S.C. 154(b) by 0 days.

(21) Appl. No.: 10/369,996

(22) Filed: Feb. 20, 2003

(65) Prior Publication Data

US 2003/0154695 A1 Aug. 21, 2003

Related U.S. Application Data

(60) Provisional application No. 60/358,542, filed on Feb. 21, 2002.

(51) Int. Cl.[7] ..... B65B 53/02; B65B 35/56

(52) U.S. Cl. ..... 53/493; 53/156; 53/540; 53/544; 53/556; 414/788.6; 414/788.8; 414/789.6; 414/796; 414/796.4

(58) Field of Search ..... 53/556, 493, 152–157, 53/540, 544; 414/788.4, 788.6, 788.8, 789.5, 789.6, 796, 796.4

(56) References Cited

U.S. PATENT DOCUMENTS 3,531,912 A * 10/1970 Griner et al. ..... 53/156
4,157,825 A * 6/1979 Ellenberger et al. ..... 414/796.9
4,161,368 A * 7/1979 Batzdorff ..... 414/796
4,986,726 A * 1/1991 Benuzzi et al. ..... 414/789.1
5,414,974 A * 5/1995 Van de Ven et al. ..... 53/399
5,619,942 A 4/1997 Stewart et al.
5,669,320 A 9/1997 Stewart et al.
5,685,248 A 11/1997 Stewart et al.
5,928,462 A 7/1999 Stewart et al.
6,058,863 A 5/2000 Stewart et al.
6,136,120 A 10/2000 Stewart et al.
6,260,495 B1 7/2001 Stewart et al.
6,499,416 B2 12/2002 Stewart et al.
6,615,565 B2 * 9/2003 Dekker ..... 53/556
2002/0108549 A1 8/2002 Trobaugh, III et al.

* cited by examiner

*Primary Examiner*—Stephen F. Gerrity
(74) *Attorney, Agent, or Firm*—Sutherland Asbill & Brennan LLP

(57) ABSTRACT

A product packaging system for organizing and packing a number of different items into a set. The system may include a number of staging conveyors. Each of the staging conveyors may carry a stack of items from the number of different items. The system further may include a positioning conveyor positioned adjacent to the staging conveyors and a number of removal devices positioned adjacent to the positioning conveyor. The removal devices may remove one item from the stack of items on each of the staging conveyors and place the item on the positioning conveyor. The system also may include one or more rotation devices positioned about the positioning conveyor so as to rotate the one items on the positioning conveyor.

24 Claims, 4 Drawing Sheets

SHEET SETS PACKAGING SYSTEM

RELATED APPLICATIONS

The present application claims priority to Provisional Application Ser. No. 60/358,542, filed on Feb. 21, 2002.

TECHNICAL FIELD

The present invention relates generally to packaging systems and more particularly relates to methods and systems for organizing and packaging sets of sheets or other types of stackable products.

BACKGROUND OF THE INVENTION

The packaging of textile products generally has been a manual process. For example, a set of sheets 10 generally may include a fitted sheet 20, one or more pillowcases 30, and a flat sheet 40. A worker generally would take the fitted sheet 20, place one or more of the pillowcases 30 on top of the fitted sheet 20, and then place the flat sheet 40 on top of the pillowcases 30. The worker would insure that the sheets 20, 40 and the pillowcases 30 are properly aligned. The worker then would place a J-board 50 around the sheets 20, 40 and the pillowcases 30. The J-board 50 may be a printed piece of material, such as cardboard, with promotional and/or identifying indicia thereon. The sheets 20, 40, the pillow cases 30, and the J-board 50 then may be placed within a wrapping device such as a shrink-wrap machine so as to apply a layer of shrink-wrap 60 or other type of wrapping to package the set of sheets 10. The set 10 then may have a label or other types of finishings applied. The set 10 then may be packed and shipped to the consumer. Other than the actual application of the shrink-wrap layer 60 and the label, to date this process has been almost completely manual and time intensive.

There is a desire, therefore, to automate, at least in part, the process of producing the set of sheets 10 or any other type of grouping of product elements that must be organized, arranged, and wrapped. The process and system preferably should be easy to use and produce a high quality finished product in a lesser amount of time as compared to the manual process.

SUMMARY OF THE INVENTION

The present invention thus provides a product packaging system for organizing and packing a number of different items into a set. The system may include a number of staging conveyors. Each of the staging conveyors may carry a stack of items from the number of different items. The system further may include a positioning conveyor positioned adjacent to the staging conveyors and a number of removal devices positioned adjacent to the positioning conveyor. The removal devices may remove one item from the stack of items on each of the staging conveyors and place the item on the positioning conveyor. The system also may include one or more rotation devices positioned about the positioning conveyor so as to rotate the one items on the positioning conveyor.

The product packaging system further may include a number of product stack backups positioned adjacent to the staging conveyors. The product stack backups may have a product plate that is positionable behind one of the stacks of items.

The positioning conveyor may include a number of conveyors that define an aperture therebetween. The rotation devices may be positioned within the aperture. The rotation devices may include a product plate, rotation drive means so as to rotate the plate, and vertical drive means so as to elevate the product plate.

The removal devices may include a number of product paddles with reciprocating drive means. The removal devices may include a number of stop guides with reciprocating drive means positioned adjacent to the product paddles. The removal devices may include vertical drive means so as to maneuver the product paddles and the stop guides. The removal devices may include a vision device so as to distinguish an individual item from the stack of items on the conveyors. The vision device may be a machine vision sensor.

The staging conveyors may include a first staging conveyor with a first stack of items, a second staging conveyor with a second stack of items, and a third staging conveyor with a third stack of items. The removal devices may include a first device to remove a first item from the first stack and to place the first item on the positioning conveyor, a second device to remove a second item from the second stack and to place the second item on the first item, and a third device to remove a third item from the third stack and to place the third item on the second item. The rotational devices may include a first device to rotate the first item, a second device to rotate the first item and the second item, and a third device to rotate the first item, the second item, and the third item.

The system further may include a third conveyor. The positioning conveyor may include a retractable conveyor nose so as to position the items on the third conveyor. The system further may include a J-board device for covering the set with a J-board. The J-board device may include positioning means and a vacuum source to cover the set with the J-board. The system further may include a shrink-wrap device to shrink-wrap the set.

A further embodiment of the present invention may provide for a product packaging system for organizing and packing a number of sheets and pillowcases. The system may include a number of staging conveyors with a first staging conveyor carrying a stack of sheets and a second staging conveyor carrying a stack of pillowcases. The system also may include a positioning conveyor positioned adjacent to the staging conveyors and a number of removal devices positioned adjacent to the positioning conveyor. A first removal device may remove one sheet from the stack of sheets and place the sheet on the positioning conveyor and a second removal device may remove one pillowcase from the stack of pillowcases and place the pillowcase on the sheet on the positioning conveyor. The system also may include one or more rotation devices positioned about the positioning conveyor so as to rotate the sheet and/or the pillowcase. The removal devices may include a vision device so as to distinguish an individual sheet from the stack of sheets and/or an individual pillowcase from the stack of pillowcases.

A method of the present invention may create a set of different items. The method may include the steps of separating a first item from a stack of first items, rotating the first item, advancing the first item along a predetermined path, separating a second item from a stack of second items, placing the second item on the first item, rotating the first item and the second item, advancing the first item and the second item along the predetermined path, and shrink-wrapping the first item and the second item to form the set.

Other features of the present invention will become apparent upon review the following detailed description of the embodiments when taken in conjunction with the drawings and the appended claims.

DETAILED DESCRIPTION

Figure 1:
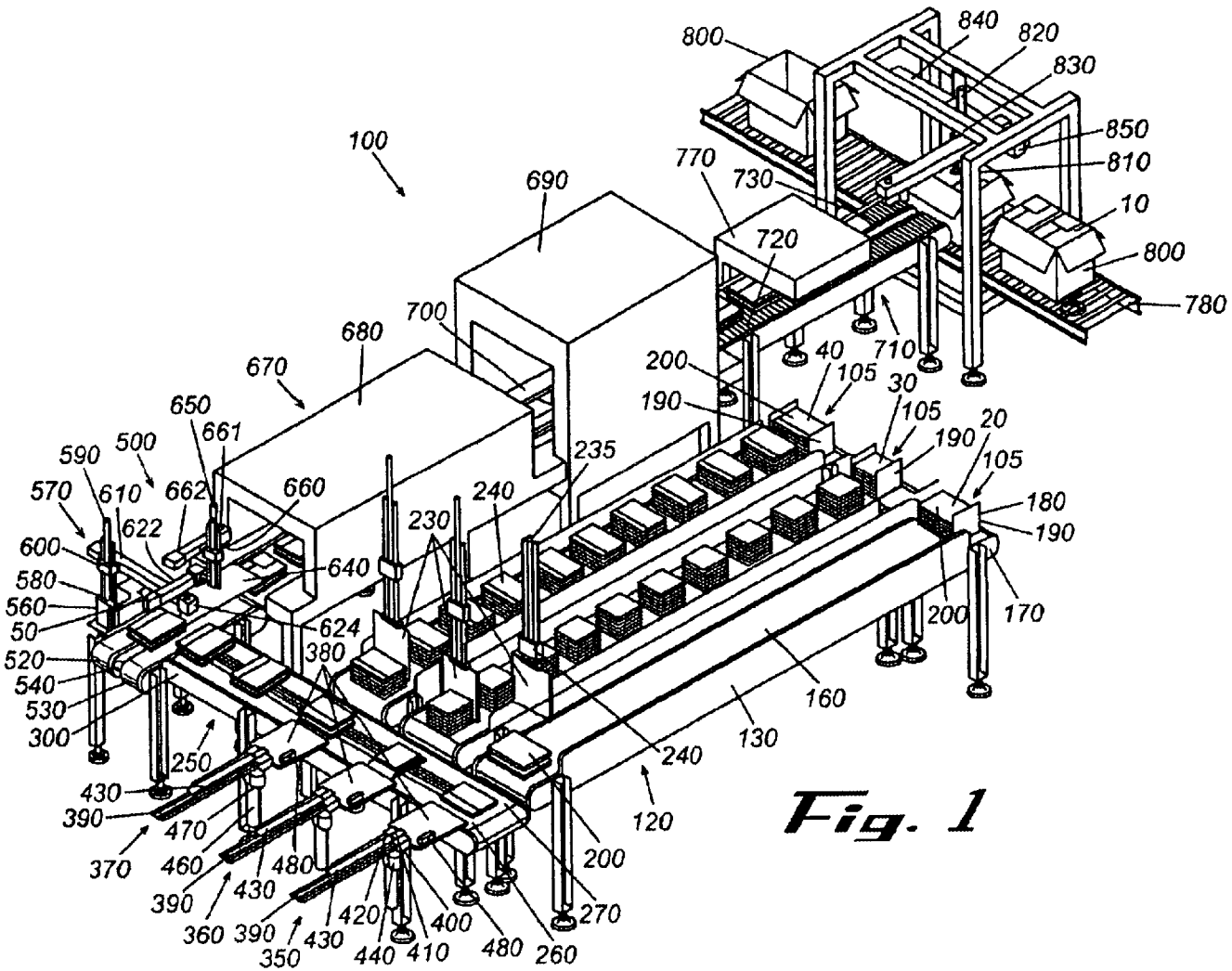
FIG. 1 is a perspective view of the sheet sets packaging system of the present invention.
Figure 2:
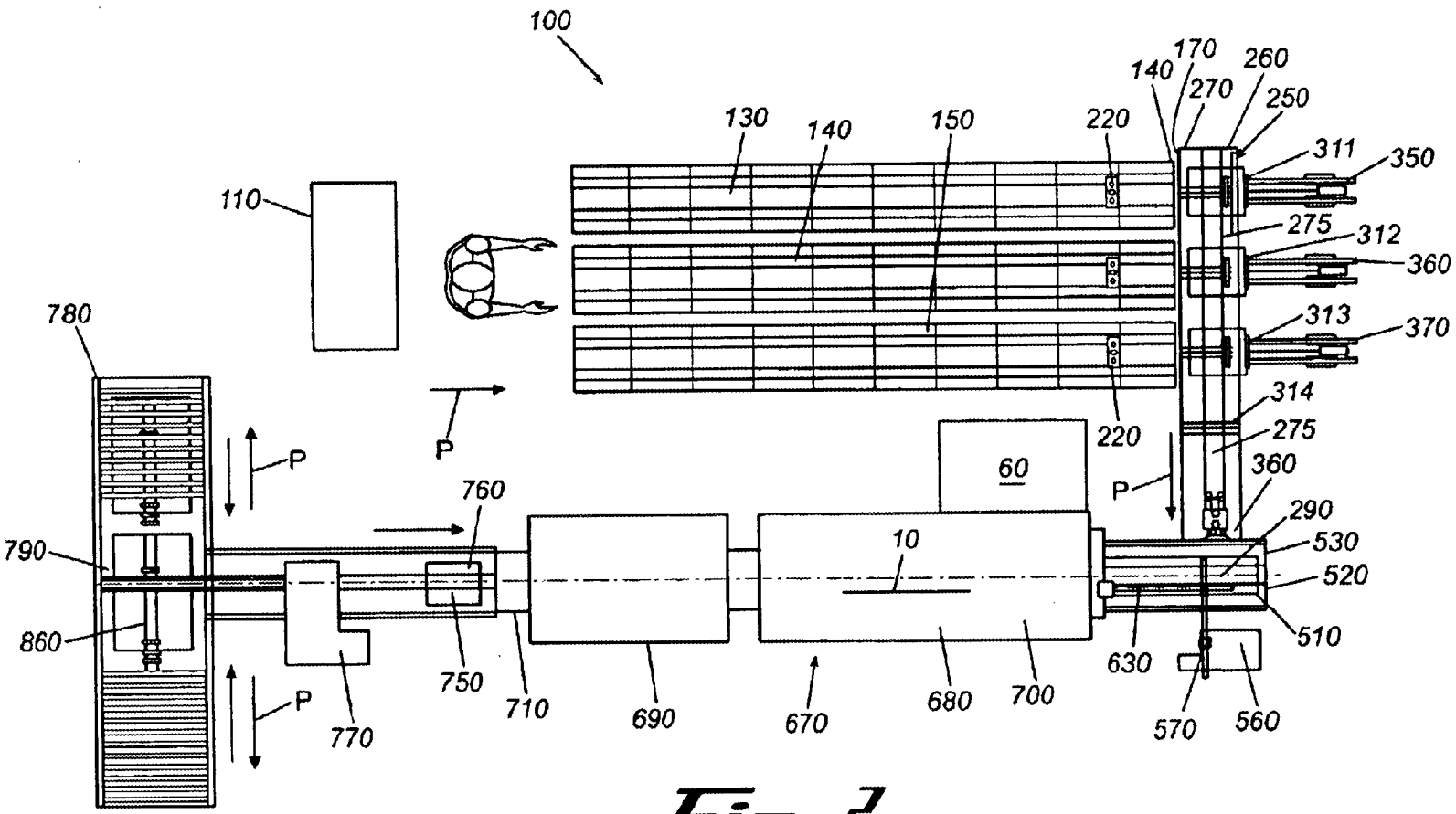
FIG. 2 is a top plan view of the sheet sets packaging system of FIG. 1.

Referring now to the drawings in which like numerals represent like elements throughout the several views, FIGS. 1 and 2 show a packaging system 100 of the present invention. The packaging system 100 may be used with a number of products 105. The products 105 may be the set of sheets 10 as described above. The packaging system 100 also may be used with other textile products such as blankets, curtains, valances, tablecloths, or similar types of products. The packaging system 100 also may be used with any set of items that may be stacked or otherwise organized and then wrapped. For example, the packaging system 100 may be used with literature packets or similar types of items.

Operation of the various components of the packaging system 100 may be set, monitored, and controlled by a controller 110. The controller 110 may be a personal computer, a programmable controller, or other types of conventional control means. The controller 110 may be a conventional IBM-compatible PC with a microprocessor such as a Pentium® Microprocessor sold by Intel Corporation of Santa Clara, Calif.

The packaging system 100 may operate in an assembly line fashion along a pre-determined path P. The predetermined path P may advance along and through the various stations as described below. The predetermined path P may take various turns so as to minimize the overall size of the packaging system 100. These turns in the predetermined path P may not be necessary for the operation of the packaging system 100 as a whole.

Positioned along the pre-determined path P may be a number of staging conveyors 120. In the present embodiment, three (3) staging conveyors 120 may be used, a first staging conveyor 130, a second staging conveyor 140, and a third staging conveyor 150. These three (3) staging conveyors 120 are used given the fact that the set of sheets 10 includes the three (3) elements described above, the fitted sheet 20, the pillow covers 30, and the flat sheet 40. Any number of staging conveyors 120, however, may be used. The staging conveyors 120 may be largely of conventional design. Each staging conveyor 120 may have a conveyor belt 160 that indexes forward by a pre-determined distance on each advance. The conveyor belt 160 may be made out of rubber, plastic, metal, cloth, or similar types of materials. The predetermined distance may be about five (5) to about ten (10) feet. Any distance, however, may be used. The conveyor belt 160 may be driven by a stepper motor, an A/C motor, a D/C motor, a servo motor, a pneumatic cylinder, a hydraulic cylinder, or similar types of drive means. The use of an indexing advance allows the three (3) conveyors 130, 140, 150 to move in a controlled fashion. The controller 110 may control the operation of the staging conveyors 120.

Positioned about a first end 170 of each of the staging conveyors 120 may be one or more centering chutes 180. The centering chutes 180 each may have a pair of moveable guides 190 that may move in and out so as to center the products 105 about the middle of the conveyor belt 160. The moveable guides 190 may be manually or automatically set. The movable guides 190 may be made out of plastic, stainless steel, aluminum, or similar types of materials. A number of the products 105 may be positioned within the centering stacks 180 so as to form a product stack 200, i.e., a number of the products 105 stacked together.

Positioned over a second end of each of the staging conveyors 120 may be a product stack backup 220. Each product stack backup 220 may include a plate 230 positioned for movement along an elongated shaft 235. The plate 230 may be a substantially flat element and may be made out of metal, plastic, or any type of substantially rigid material. The elongated shaft 235 may be made out of stainless or other types of steel, plastics, or similar types of materials. The plate 230 may maneuver along the elongated shaft 235 via a plate drive 240. The plate drive 240 may be a conventional air cylinder, a linear servo motor, a linear stepper motor, or a similar type of drive means. The plate drive 240 may maneuver the plate 230 in a substantially vertical direction. The plate drive 240 may raise the plate 230 such that one of the product stacks 200 may index underneath the plate 230. The plate drive 240 may then lower the plate 230 immediately behind the advancing product stack 200. The controller 110 may control the operation of the product stack backup 220.

Positioned about the second end 210 of the staging conveyors 120 may be a positioning conveyor 250. The positioning conveyor 250 may be positioned at about a right angle to the staging conveyors 120 such that the predetermined path P turns in a substantially perpendicular direction. Each staging conveyor 120 may be aligned with the positioning conveyor 250. The positioning conveyor 250 may be substantially identical to the staging conveyors 120 described above. The positioning conveyor 250, however, may have two (2) conveyor belts, a first conveyor belt 260 and a second conveyor belt 270. The conveyor belts 260, 270 may be positioned on the positioning conveyor 250 and separated by about a pre-determined distance. The conveyor belts 260, 270 may define an aperture 275 positioned therebetween. The conveyor belts 260, 270 may be made out of rubber, plastic, metal, cloth, or similar types of materials. A stepper motor, an A/C motor, a D/C motor, a servo motor, a pneumatic cylinder, a hydraulic cylinder, or similar types of drive means may drive the conveyor belts 260, 270. The conveyor belts 260, 270 may index forward by about a predetermined distance and about at the same speed. The predetermined distance may be about one (1) foot to about three (3) feet. Any distance may be used. The controller 110 may control the operation of the positioning conveyor 250.

Figure 3:
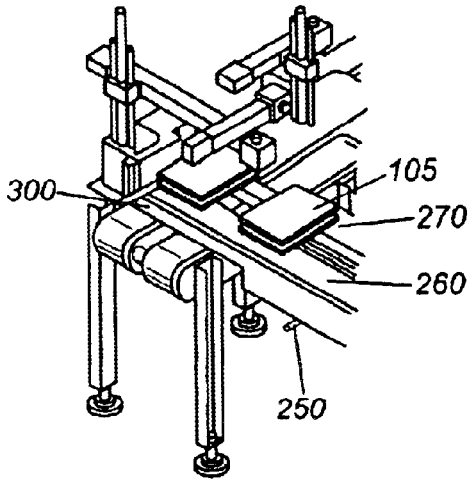
FIG. 3 is a perspective view of the retractable nose of the positioning conveyor of the system of FIG. 1.
Figure 3A:
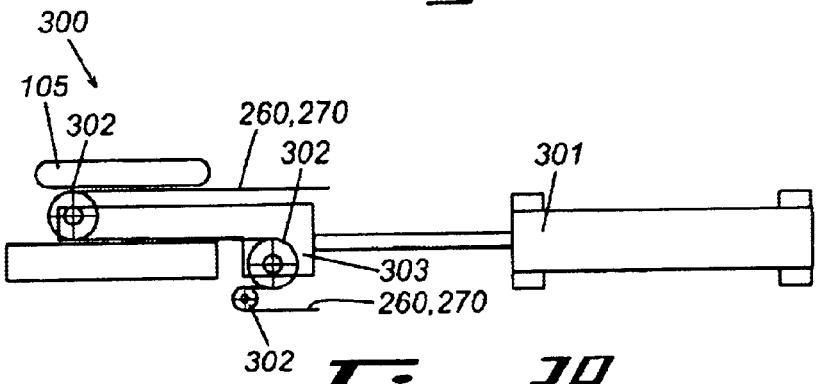
FIG. 3A is side plan view of the retractable conveyor nose of FIG. 3.

The positioning conveyor 250 may have a first end 280 positioned adjacent to each of the staging conveyors 130, 140, 150. As is shown in FIG. 3, the positioning conveyor 250 also may have a second end 290 with a retractable conveyor nose 300. The retractable conveyor nose 300 may extend the length of the conveyor 250 by about a predetermined distance. The retractable conveyor nose 300 may be extended via a retractable drive 301. The retractable drive 301 may be a stepper motor, an A/C motor, a D/C motor, a servo motor, a pneumatic cylinder, a hydraulic cylinder, or similar types of drive means. As is shown in FIG. 3A, the length of the conveyor belts 260, 270 may be adjusted by running the conveyor belts 260, 270 through a series of rollers 302 mounted on a slide 303. In the fully extended position, the conveyor belts 260, 270 may extend to their maximum length. When the slide 303 is retracted, the belts 260, 270 may be wrapped along the slide rollers 302 to pick up the slack. The controller 110 may control the operation of the retractable conveyor nose 300.

Figure 4:
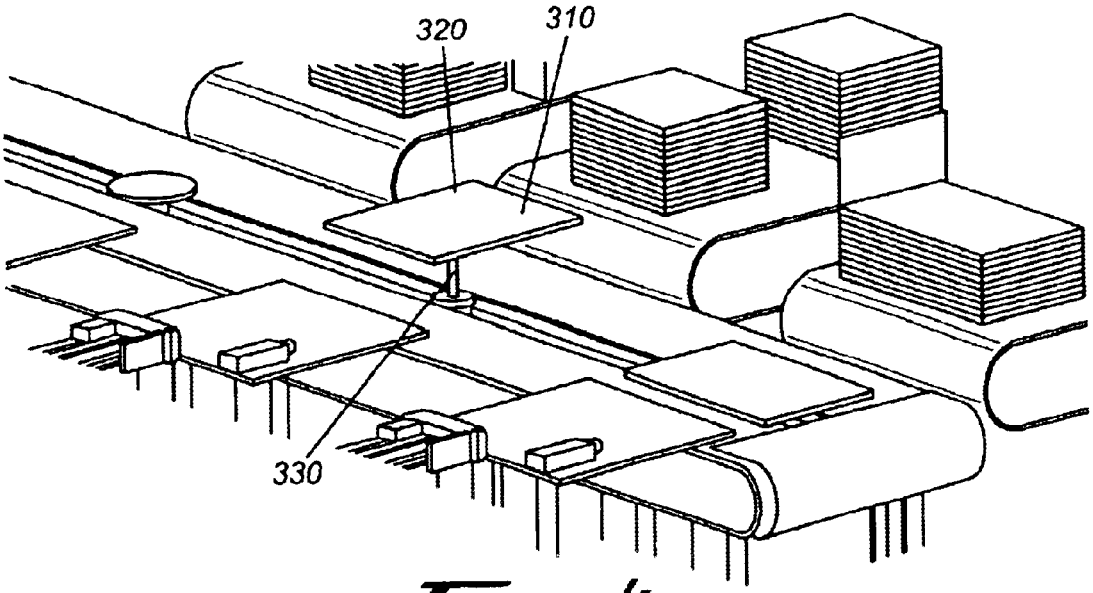
FIG. 4 is a perspective view of a pillowcase being rotated into position via the positioning device of the system of FIG. 1.

As is shown in FIG. 4, a number of rotation devices 310 may be positioned between the conveyor belts 260, 270 and within the aperture 275 of the positioning conveyor 250. One of the rotation devices 310 may be positioned along the positioning conveyor 250 adjacent to each of the staging conveyors 120. Additional rotation devices 310 also may be positioned anywhere along the positioning conveyor 250. In this case, four (4) rotation devices 310 may be used, a first rotation device 311, a second rotation device 312, a third rotation device 313, and a fourth rotation device 314. Any number of rotation devices 310 may be used.

The rotation devices 310 each may include a substantially flat plate 320 positioned for vertical movement on top of an elongated shaft 330. The flat plate 320 may be made out of plastic, stainless or other types of steel, aluminum, or similar types of materials. The elongated shaft 330 may be made out of plastic, stainless or other types of steel, aluminum, or similar types of materials. The elongated shaft 330 may raise and lower the flat plate 320 via a stepper motor, an A/C motor, a D/C motor, a servo motor, a pneumatic cylinder, a hydraulic cylinder, or similar types of elevation means. Rotational motion may be provided to the elongated shaft 330 via a stepper motor, an A/C motor, a D/C motor, a servo motor, a pneumatic cylinder, a hydraulic cylinder, an actuator, or similar types of drive means. The elongated shaft 330 may rotate the flat plate 320 by about ninety (90) or about one hundred eighty (180) degrees, depending upon the orientation of the products 105. The rotation device 310, however, may rotate in any manner. The controller 110 may control the operation of each of the rotation device 310.

Positioned adjacent to the positioning conveyor 250 and in alignment with each of the staging conveyors 130, 140, 150 may be a number of paddle systems 340. In this embodiment, three (3) paddle systems 340 may be used, a first paddle system 350, a second paddle system 360, and a third paddle system 370. The first paddle system 350 aligns with the first staging conveyor 130; the second paddle system 360 aligns with the second staging conveyor 140; and the third paddle system 370 aligns with the third staging conveyor 150. As many paddle systems 340 as is desired may be used.

Each paddle system 340 may include a product paddle 380. Each product paddle 380 may be in the form of a substantially flat plate. The product paddles 380 may be made out of plastic, stainless or other types of steel, aluminum, or similar types of substantially rigid materials. The product paddles 380 may be relatively thin so as to separate individual products 105 from the product stack 200. The product paddles 380 may have a thickness of about 0.6 to about 0.25 inches.

Each product paddle 380 may be attached to an elongated shaft 390. The elongated shaft 390 may be made out of plastic, stainless or other types of steel, or similar types of materials. The elongated shaft 390 may be mounted for reciprocating horizontal motion via a paddle drive system 400. The paddle drive system 400 may maneuver the elongated shaft 390 via a stepper motor, an A/C or a D/C linear servo motor, a pneumatic cylinder, a hydraulic cylinder, or similar types of drive means. The controller 110 may control the operation of the paddle drive system 400.

Positioned adjacent to each elongated shaft 390 and product paddle 380 may be a stop guide 410. The stop guide 410 may include a blunt face 420 fixedly attached to a stop guide elongated shaft 430. The blunt face 420 may be made out of stainless or other types of steel, plastics, or similar types of materials. The elongated shaft 430 may be made out of stainless or other types of steel, plastics, or similar types of materials. The stop guide 410 also may include a stop guide drive 440 so as to maneuver the blunt face 420 and the stop guide elongated shaft 430 in a horizontal, reciprocating fashion on top of the product paddle 380. The stop guide drive 440 may include a stepper motor, an A/C or D/C stepper motor, a pneumatic cylinder, a hydraulic cylinder, or similar types of drive means. The controller 110 may control the operation of the stop guide 410.

Both the product paddle 380 and the stop guide 410 may be attached to a vertical drive system 450. The vertical drive system 450 may include a vertical shaft 460 and a vertical drive 470. The vertical drive system 450 may maneuver the product paddle 380 and the stop guide 410 in a reciprocating vertical motion. The vertical shaft 460 may be made out of stainless or other types of steel, plastics, or similar types of materials. The vertical drive 470 may be a stepper motor, an A/C motor, a D/C motor, a servo motor, a pneumatic cylinder, a hydraulic cylinder, or similar types of drive means.

Positioned on the product paddle 380 may be a vision system 480. The vision system 480 may detect the positioning of each individual product 105 within the product stack 200 so as to determine the desired vertical height for the product paddle 380 and the stop guide 410. Specifically, the vision system 480 may detect the shadow between each of the products 105 on the product stack 200. For purposes of example only, the vision system 480 may include a conventional machine vision sensor with a sensitivity of about 640×480 and about 256 gray levels (about 8 bits per pixel). An acceptable vision sensor for use in the present invention is sold by Cognex Corporation of Natick, Mass. under the "In-Sight" marks for either integrated camera and processor sets or separate camera and processor sets. Any suitable type of vision or other type of detection system, however, may be used herein. The controller 110 and/or a separate processor in coordination with the controller 110 may control the operation of the vision system 480. Vision or other types of detection system may be used elsewhere in the system 100 as a whole.

Figure 5:
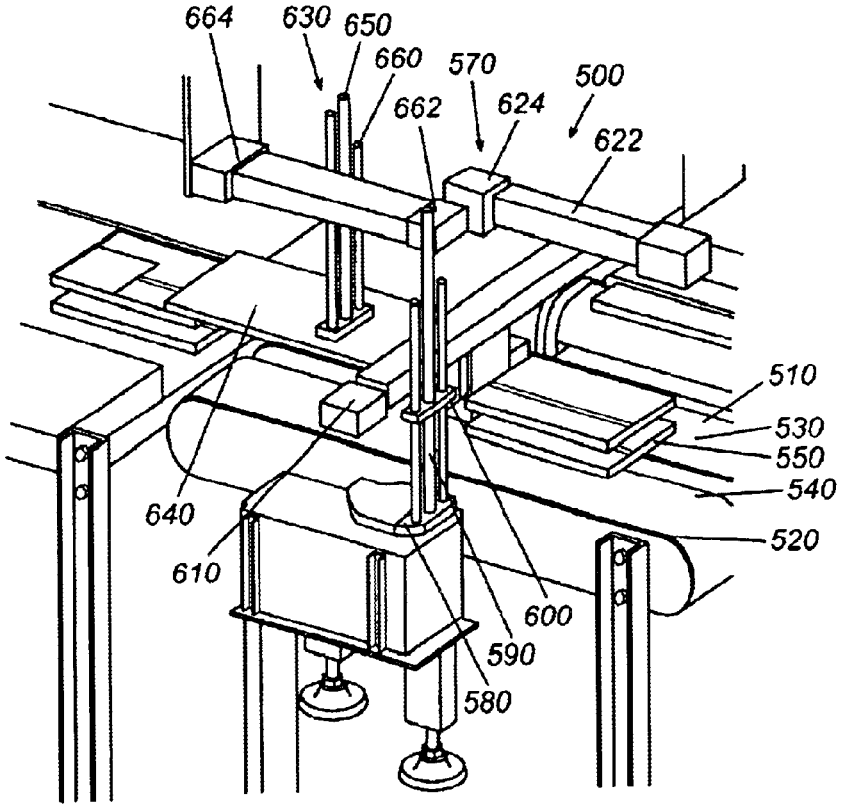
FIG. 5 is a perspective view of the J-board assembly of the system of FIG. 1.

As is shown in FIG. 5, a J-board device 500 may be positioned adjacent to the second end 290 of the positioning conveyor 250. The J-board device 500 may include a J-board conveyor 510. The J-board conveyor 510 may be substantially similar to the conveyors 120, 250 described above. The J-board conveyor 510 may be positioned at about a right angle to the positioning conveyor 250 such that the pre-detenmined path P takes a further perpendicular turn. The J-board conveyor 510, however, may be positioned at any convenient angle with respect to the positioning conveyor 250. For example, the J-board conveyor 510 also could be in line with the positioning conveyor 250 if the length of the overall packaging system 100 is not an issue.

The J-board conveyor may have two (2) conveyor belts, a first conveyor belt 520 and a second conveyor belt 530. The conveyor belts 520, 530 may be made out of rubber, plastic, metal, cloth, composites, or similar types of materials. A stepper motor, an A/C motor, a D/C motor, a servo motor, a pneumatic cylinder, a hydraulic cylinder, or similar types of drive means may drive the conveyor belts 520, 530. The controller 110 may control the operation of the conveyor belts 520, 530.

The first and second conveyor belts 520, 530 may define an aperture 540 therebetween. Positioned within the aperture 540 of the J-board conveyor 510 may be a vacuum device 550. The vacuum device 550 may be a conventional vacuum pump or a similar type of device. The controller 110 may control the operation of the vacuum device 550.

Positioned adjacent to the J-board conveyor 510 may be a J-board stack holder 560. The J-board stack holder 560 may hold a stack of the J-boards 50. The J-board stack holder 560 may be made out of stainless or other types of steels, plastics, or similar types of materials.

The J-board device 500 may include a J-board positioner 570. The J-board positioner 570 may be capable of movement along three (3) axes. The J-board positioner 570 may include a vertical shaft 590 driven by a vertical drive 600 for movement in the Z axis, a first horizontal shaft 610 driven by a first horizontal drive 620 for movement in the X axis, and a second horizontal shaft 622 driven by a second horizontal drive 624 for movement in the Y axis. The shafts 590, 610, 622 may be made out of stainless or other types of steel, or similar types of materials. The drives 600, 620, 624 may be a stepper motor, an A/C motor, a D/C motor, a servo motor, a pneumatic cylinder, a hydraulic cylinder, or similar types of drive means.

The J-board positioner 570 may include a vacuum plate 580 connected to the vertical shaft 590. The vacuum plate 580 may be made out of stainless or similar types of steel, aluminum, plastics, or similar types of materials. The vacuum plate 580 may be sized so as to pick up a typical J-board 50. The vacuum plate 580 may be connected to a vacuum source. The J-board positioner 570 thus may be able to remove a J-board 50 from the J-board stack holder 560 and then maneuver the J-board 50 to the vacuum device 550 positioned between the conveyor belts 520, 530 of the J-board conveyor 510. The controller 110 may control the operation of the J-board positioner 570.

Positioned adjacent to the J-board positioner 570 may be a folding device 630. The folding device 630 may include a platen 640 capable of vertical movement via a vertical shaft 650 and a vertical drive 660 and horizontal movement via a horizontal shaft 662 and a horizontal drive 664. The platen 640 may be made out of aluminum, stainless or other types of steels, or similar types of materials. The shafts 650, 662 may be made out of stainless or other types of steels, or similar type of materials. The drives 660, 664 may include a stepper motor, an A/C motor, a D/C motor, a servo motor, a pneumatic cylinder, a hydraulic cylinder, or similar types of drive means.

The vertical shaft 650 and the vertical drive 660 may raise and lower the platen 640 so as to accommodate the height of the particular products 105 in use. The horizontal shaft 662 and the horizontal drive 664 may accommodate the size of the products 105 and the size of the J-board 50 so as to bend the J-board 50 as the J-board positioner 570 maneuvers the J-board 50 into place. The platen 640 then completes the fold of the J-board 50 as the product stack 200 maneuvers down the J-board conveyor 510. Alternatively, the horizontal drive 664 may maneuver the platen 640 over the J-board 50 and the products 105 so as to complete the fold. The controller 110 may control the operation of the folding device 630.

Positioned adjacent to the J-board device 500 along the pre-determined path P may be a shrink-wrap device 670. The shrink-wrap device 670 may be of conventional design. The shrink-wrap tunnel 670 may be manufactured by Signature Packaging Machinery, Inc. of Albermarle, N.C. Similar types of shrink-wrap devices 670 also may be used. The shrink-wrap device 670 may include a wrapping tunnel 680 where the shrink-wrap 60 itself is placed over the products 105 and the J-board 50 and a heating tunnel 690 where the shrink-wrap 60 is heated so as to form the packaging for the set of sheets 10. The shrink-wrap device 670 also may include an internal conveyor 700. The conveyor 700 may be substantially identical to the conveyors 120, 250, 510 described above. Operation of the shrink-wrap device 670 is known to those skilled in the art. The specific type of shrink-wrap device 670 used herein should not limit the scope of the invention. The controller 110 may control operation of the shrink-wrap device 670. Other types of wrapping devices or packaging materials also may be used herein.

Positioned adjacent to the shrink-wrap device 670 may be an out-feed conveyor 710. The out-feed conveyor 710 continues along the pre-determined path P. The out-feed conveyor 710 also may be substantially identical to the conveyors 120, 250, 510, 700 described above. The out-feed conveyor may have two (2) conveyor belts, a first conveyor belt 720 and a second conveyor belt 730. The conveyors belts 720, 730 may define an aperture 740 therebetween. The controller 110 may control the operation of the out-feed conveyor 710.

Positioned within the aperture 740 of the out-feed conveyor 710 may be a package up-ender 750. The package up-ender 750 may include a rotatable arm 760 so as to rotate the set of sheets 10 or other products 105 by about 180 degrees. The rotatable arm 760 may be made out of stainless or other types of steels, aluminum, plastics, or similar types of materials. The rotatable arm 760 may be driven by a stepper motor, an A/C motor, a D/C motor, a servo motor, a pneumatic cylinder, a hydraulic cylinder, or similar types of drive means. Operation of the up-ender 750 is known to those skilled in the art. The specific type of up-ender 750 used herein should not limit the scope of the invention. The controller 110 may control the operation of the up-ender 750.

Positioned adjacent to the package up-ender 750 along the out-feed conveyor 710 may be a label applicator 770. The label applicator 770 may attach a preprinted label or a print and apply label directly to the shrink-wrap 60 around the set of sheets 10. The label applicator 770 may be of conventional design. Operation of the label applicator 770 is known to those skilled in the art. The specific type of label applicator 770 used herein should not limit the scope of the invention. The controller 110 may control the operation of the label applicator 770.

Positioned adjacent to the out-feed conveyor 710 may be a discharge conveyor 780. The discharge conveyor 780 may be substantially identical to the conveyors 120, 260, 510, 700, 710 described above. The pre-determined path P may turn at about a right angle such that the discharge conveyor 780 may be largely perpendicular to the out feed conveyor 710.

Positioned adjacent to the discharge conveyor 780 may be a product removal device 790. The product removal device 790 may be maneuverable with respect to three (3) axes. The product removal device 790 may be of conventional design and may place the set of sheets 10 or other products 105 within a carton 800 or other type of holding device. The product removal device 790 may include a vacuum plate 810. The vacuum plate 810 may be made out of stainless or other types of steels, aluminum, plastics, or similar types of materials. The vacuum plate 810 may be sized so as to pick up a typical set of sheets 10. The product removal device 790 may include a vertical shaft 820 driven by a vertical drive 830 for movement in the Z axis, a first horizontal shaft 840 driven by a first horizontal drive 850 for movement in the X axis, and a second horizontal shaft 860 driven by a second horizontal drive 870 for movement in the Y axis. The shafts 820, 840, 860 may be made out of stainless or other types of steels or similar types of materials. The drives 830, 850, 870 may include a stepper motor, an A/C motor, a D/C motor, a servo motor, a pneumatic cylinder, a hydraulic cylinder, or similar types of drive means. The product removal device 790 thus may be able to remove the set of sheets 10 from the out-feed conveyor 710 and then maneuver the set 10 to the discharge conveyor 780. The controller 110 may control operation of the product removal device 790.

In use, the user sets the controller 110 to indicate the nature of the products 105 to be used within the packaging system 100. In the case of the set of sheets 10, the user would inform the controller 110 of the nature of the individual sheets 20, 40, pillowcases 30, and the J-board 50. The controller 110 would then set the elements of the packaging system 100 as a whole to accommodate the size and nature of the components.

The user would then place the products 105 within the staging conveyors 120. For example, a set of fitted sheets 20 would be placed within the first staging conveyor 130, a set of pillow covers 30 would be placed in the second staging conveyor 140, a set of flat sheets 40 would be placed within the third staging conveyor 150, and a set of J-boards 50 would be placed within the J-board stack holder 560. Any number of products 105 may be placed within each centering chute 180 to form the product stack 200. The user may load the products 105 such that a certain end is facing the positioning conveyor 250. For example, the sheets 20, 40 and pillowcases 30 may have the folded end facing the positioning conveyor 250 so as to accommodate the vision system 480.

The user would adjust the movable guides 190 so as to center the elements 20, 30, 40 along the conveyor belt 160 for each staging conveyor 130, 140, 150. The conveyor belts 160 of the staging conveyors 130, 140, 150 would then index forward from the first end 170 to the second end 210. Once the first product stack 200 reached the second end 210 of each conveyor 130, 140, 150, the product stack backup 220 will descend immediately behind the product stack 200 on the second end 210. The product stack backup 220 prevents the product stack 200 from moving during the operations as described below.

Figure 6:
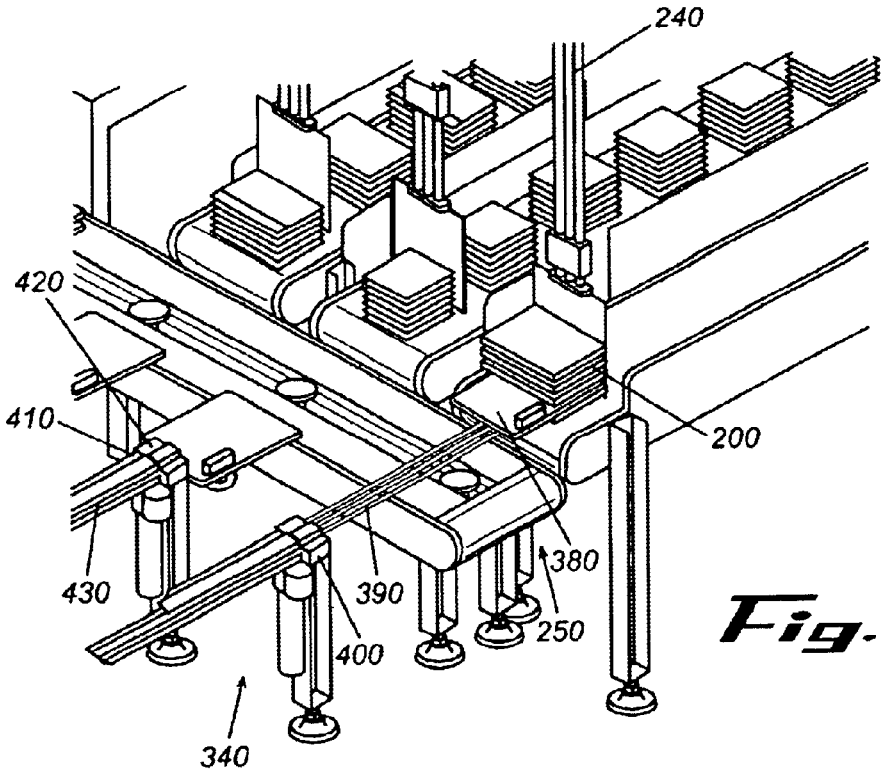
FIG. 6 is a perspective view of a sheet being removed from the stack of the system of FIG. 1.

As is shown in FIG. 6, the paddle systems 340 then proceed to place the products 105 onto the positioning conveyor 250. The first paddle system 350 may be engaged such that the product paddle 380 and the stop guide 410 are raised via the vertical drive 470. The vision system 480 may detect the shadow between the top product 105 and the second product 105 of the product stack 200. The vision system 480 may inform the controller 110 where that shadow may be such that the vertical drive 470 will raise the product paddle 380 and the stop guide 410 to the appropriate height. The product paddle 380 is then extended in a horizontal direction by the paddle drive 400 such that the top product 105 is placed thereon with the aid of the plate 230 of the product stack backup 220.

Once the product paddle 380 is positioned under the first product 105, the product paddle 380 may be raised and then retracted somewhat in the horizontal direction. The product paddle 380 and the stop guide 410 may then be lowered by the vertical drive 470 until the product paddle 380 is about 0.25 to about 0.5 inches above the positioning conveyor 250. The blunt face 420 of the stop guide 410 also is extended horizontally via the stop guide drive 440 to the appropriate position over the positioning conveyor 250. The product paddle 380 is then withdrawn further such that the blunt face 420 of the stop guide 410 forces the product 105 onto the positioning conveyor 250. The particular order of the positioning events described above is not necessary to the invention as a whole.

The product stack backup 220 then may raise the plate 230 such that the first staging conveyor 130 may index forward until the next product stack 200 approaches the second end 210 of the conveyor 130. The product stack backup 220 then again lowers the plate 230.

Due to the matter in which the products 105 may be loaded onto the staging conveyors 120 or for ease in picking up individual products 105, it may be desired to rotate the product 105. The product 105 therefore may be rotated by the first rotation device 311 positioned adjacent to the first staging conveyor 130. Alternatively, the positioning conveyor 250 may index forward such that the product 105 is adjacent to the second staging conveyor 140 and then may be rotated by the second rotation device 312. The product 105 therefore may be rotated, if necessary, at either location. In order to rotate the product 105, the flat plate 320 elevates the product 105 off of the conveyor belts 260, 270 of the positioning conveyor 250. The flat plate 320 is then rotated 90 degrees, 180 degrees, or whatever amount of rotation may be desired. The flat plate 320 is then lowered such that the product 105 is again positioned on the conveyor belts 260, 270.

Once the first product 105, in this case the fitted sheet 20, is positioned adjacent to the second staging conveyor 140, the second paddle system 360 then may remove the product 105, in this case the pillowcase 30, from the second end 210 of the second staging conveyor 140. The paddle second system 360 operates in a substantially identical manner to that described above with respect to the first paddle system 350. Specifically, the top pillowcase 30 may be removed from the product stack 200 and placed on top of the fitted sheet 20. The rotation device 312 adjacent to the second staging conveyor 140 then may rotate the products 105 thereon, the fitted sheet 20 and the pillow cover 30. Alternatively, the positioning conveyor 250 may index forward such that the products 105 are now adjacent to the third staging conveyor 150 and the third rotation device 313. The rotation device 310 adjacent to the second staging conveyor 140 or the third staging conveyor 150 may rotate the products 105.

The third paddle system 370 then may remove the top product 105, in this case the flat sheet 40, from the product stack 200 at the second end 210 of the third staging conveyor 150. The third paddle system 370 works in a substantially identical manner to the paddle system 350, 360 described above. Specifically, the flat sheet 40 may be removed from the product stack 200 and placed on top of the fitted sheet 20 and the pillowcase 30. The rotation device 313 then may rotate the products 105 if necessary. Alternatively, the positioning conveyor 250 then may index the products 105 to the fourth rotation device 314 so as to rotate the products 105 if necessary. The products 105, in this case the fitted sheet 20, the pillowcase 30, and the flat sheet 40, then may continue to index along the positioning conveyor 250.

As the products 105 advance along the positioning conveyor 250, the vacuum plate 580 of the J-board positioner 570 may be positioned over the J-board stack holder 560 and then remove a J-board 50. The J-board positioner 570 then may raise the J-board 50 via the vertical drive 600 and maneuver the J-board 50 over the J-board conveyor 510 via the horizontal drives 620, 624. The J-board positioner 570 positions the J-board 50 partially over the platen 640. The vertical drive 600 then lowers the vacuum plate 580 and J-board 50 such that one end of the J-board 50 catches the platen 640 and folds the J-board 50 over so as to form the first fold of the "J". The J-board 50 may be held in place on top of the conveyor belts 520, 530 under the force of the vacuum by the vacuum device 550.

The products 105 then may pass over the retractable conveyor nose 300 towards the J-board device 50. The retractable conveyor nose 300 positions the products 105 over the conveyor belts 520, 530 of the J-board conveyor 510. The conveyor belts 260, 270 of the positioning conveyor 250 then advance as the retractable conveyor nose 300 withdraws, thereby placing the products 105 onto the conveyors 520, 530 and the J-board 50.

Once the products 105 are positioned on the J-board 50, the J-board conveyor 510 indexes the sheets 20, 40, pillow cases 30, and J-board 50 underneath the platen 640 so as to provide the final fold for the J-board 50.

The sheets 20, 40, pillowcases 30, and J-board 50 then travel through the shrink-wrap device 670 or other type of wrapping device. Specifically, the shrink-wrap 60 is positioned on the sheets 20, 40, pillowcases 30, and J-board 50 within the wrapping tunnel 680. The sheets 20, 40, pillowcases 30, J-board 50, and shrink-wrap 60 then pass through the heating tunnel 690 where the shrink-wrap 60 is attached. The set of sheets 10 is now complete.

The set of sheets 10 may then pass along the out feed conveyor 710. The up-ender 750 then may rotate the set 10 if necessary. The set 10 may then pass through the label applier 770 if a label is to be applied. The set 10 may then be removed from the out feed conveyor via the product removal device 790 and placed in a carton 800 along the discharge conveyor 780.

Although the system 100 herein has been described in terms of numerous stations, each such station is not necessarily required to be used. Further, other or different stations may be used herein. Likewise, the predetermined path P may take any convenient course.

It should be apparent that the foregoing relates only to the preferred embodiments of the present invention and that numerous changes and modifications may be made herein without departing from the spirit and scope of the invention as defined by the following claims and the equivalents thereof.

We claim:

1. A product packaging system for organizing and packing a plurality of different items into a set, comprising:

a plurality of staging conveyors, each of said plurality of staging conveyors carrying a stack of items from said plurality of different items;

a positioning conveyor positioned adjacent to said plurality of staging conveyors;

a plurality of removal devices positioned adjacent to said positioning conveyor so as to remove one item from said stack of items on each of said plurality of staging conveyors and place said one item on said positioning conveyor; and one or more rotation devices positioned about said positioning conveyor so as to rotate said one items on said positioning conveyor.

2. The product packaging system of claim 1, further comprising a plurality of product stack backups positioned adjacent to said plurality of staging conveyors.

3. The product packaging system of claim 2, wherein said plurality of product stack backups comprise a product plate, said product plate being positionable behind one of said stacks of items.

4. The product packaging system of claim 1, wherein said positioning conveyor comprises a plurality of conveyors, said plurality of conveyors defining an aperture therebetween.

5. The product packaging system of claim 4, wherein said one or more rotation devices are positioned within said aperture.

6. The product packaging system of claim 1, wherein said one or more rotation devices comprise a product plate.

7. The product packaging system of claim 6, wherein said one or more rotation devices comprise rotation drive means so as to rotate said product plate.

8. The product packaging system of claim 6, wherein said one or more rotation devices comprise vertical drive means so as to elevate said product plate.

9. The product packaging system of claim 1, wherein said plurality of removal devices comprises a plurality of product paddles.

10. The product packaging system of claim 9, wherein said plurality of removal devices comprises reciprocating drive means so as to maneuver said plurality of product paddles.

11. The product packaging system of claim 9, wherein said plurality of removal devices comprises a plurality of stop guides positioned adjacent to said plurality of product paddles.

12. The product packaging system of claim 11, wherein said plurality of removal devices comprises reciprocating drive means so as to maneuver said plurality of stop guides adjacent to said plurality of product paddles.

13. The product packaging system of claim 11, wherein said plurality of removal devices comprises vertical drive means so as to maneuver said plurality of product paddles and said plurality of stop guides.

14. The product packaging system of claim 1, wherein said plurality of removal devices comprises a vision device so as to distinguish an individual item from said stack of items on said plurality of staging conveyors.

15. The product packaging system of claim 14, wherein said vision device comprises a machine vision sensor.

16. The product packaging system of claim 1, further comprising a third conveyor and wherein said positioning conveyor comprises a retractable conveyor nose so as to position said plurality of different items on said third conveyor.

17. The product packaging system of claim 1, further comprising a J-board device for covering said set with a J-board.

18. The product packaging system of claim 17, wherein said J-board device comprises positioning means and a vacuum source to cover said set with said J-board.

19. The product packaging system of claim 1, further comprising a shrink wrap device to shrink wrap said set.

20. The product packaging system of claim 1, wherein said plurality of staging conveyors comprises a first staging conveyor with a first stack of said plurality of different items, a second staging conveyor with a second stack of said plurality of different items, and a third staging conveyor with a third stack of said plurality of different items.

21. The product packaging system of claim 20, wherein said plurality of removal devices comprises a first device to remove a first item from said first stack and to place said first item on said positioning conveyor, a second device to remove a second item from said second stack and to place said second item on said first item, and a third device to remove a third item from said third stack and to place said third item on said second item.

22. The product packaging system of claim 21, wherein said one or more rotational devices comprise a first device to rotate said first item, a second device to rotate said first item and said second item, and a third device to rotate said first item, said second item, and said third item.

23. A product packaging system for organizing and packaging a plurality of sheets and pillowcases, comprising:

a plurality of staging conveyors, a first one of said plurality of staging conveyors carrying a stack of said plurality of sheets and a second one of said plurality of staging conveyors carrying a stack of said plurality of pillowcases;

a positioning conveyor positioned adjacent to said plurality of staging conveyors;

a plurality of removal devices positioned adjacent to said positioning conveyor, a first one of said plurality of removal devices to remove one sheet from said stack of sheets and to place said one sheet on said positioning conveyor and a second one of said plurality of removal devices to remove one pillowcase from said stack of pillowcases and to place said one pillowcase on said one sheet on said positioning conveyor; and one or more rotation devices positioned about said positioning conveyor so as to rotate said one sheet and/or said one pillowcase.

24. The product packaging system of claim 23, wherein said plurality of removal devices comprises a vision device so as to distinguish an individual sheet from said stack of sheets and/or an individual pillowcase from said stack of pillowcases.

* * * * *